US005430961A

United States Patent [19]

Faulconer et al.

[11] Patent Number: 5,430,961

[45] Date of Patent: Jul. 11, 1995

[54] REACTIVE ENERGY APPARATUS PROVIDING A CUSTOM FIT AND ANKLE SUPPORT IN A SHOE UPPER

[75] Inventors: Mark Faulconer, Newport Beach; Tim Bowman, Costa Mesa; Ian Burgess, Santa Ana, all of Calif.; Bernie Allen, Wayland, Mass.; Rui Parracho, Peabody, Mass.; Eric Swartz, Malden, Mass.

[73] Assignee: Converse Inc., North Reading, Mass.

[21] Appl. No.: 767,075

[22] Filed: Sep. 27, 1991

[51] Int. Cl.[6] ..... A43B 7/14; A43B 19/00

[52] U.S. Cl. ..... 36/93; 36/88; 36/71

[58] Field of Search ..... 36/88, 89, 91, 93, 71, 36/110, 9 R

[56] References Cited

U.S. PATENT DOCUMENTS

| | | | |
|---|---|---|---|
| 2,774,152 | 12/1956 | Auber | 36/71 |
| 2,830,585 | 4/1958 | Weiss | 36/71 |
| 3,237,319 | 3/1966 | Hanson . | |
| 3,685,176 | 8/1972 | Rudy | 36/93 |
| 4,361,969 | 12/1982 | Vermonet . | |
| 4,458,430 | 7/1984 | Peterson | 36/29 |
| 4,662,087 | 5/1987 | Beuch . | |
| 4,724,627 | 2/1988 | Sisco | 36/71 |
| 4,726,126 | 2/1988 | Bernhard | 36/88 |
| 4,744,157 | 5/1988 | Dubner . | |
| 4,912,861 | 4/1990 | Huang | 36/71 |
| 4,995,173 | 2/1991 | Spier . | |
| 5,113,599 | 5/1992 | Cohen et al. | 36/71 |

FOREIGN PATENT DOCUMENTS

| | | |
|---|---|---|
| 2215098 | 5/0373 | Germany . |
| 2845824 | 5/1979 | Germany . |

*Primary Examiner*—Steven N. Meyers
*Attorney, Agent, or Firm*—Rogers, Howell & Haferkamp

[57] ABSTRACT

A reactive energy apparatus providing a custom fit and ankle support in a shoe upper is comprised of a pair of fluid filled pads that are positioned in the upper on opposite sides of the Achilles tendon of the wearer. The fluid filled pads each contain one or more interior chambers containing fluid, and the pads are connected in fluid communication by a series of conduits extending between the pads and around the Achilles tendon of the wearer. The conduits are constructed to enable the free flow of fluid between the two pads, enabling the apparatus to provide a continuous custom fit and dynamic support for the wearer's ankle while avoiding exerting any pressure on the Achilles tendon of the wearer that could potentially injure the tendon.

5 Claims, 1 Drawing Sheet

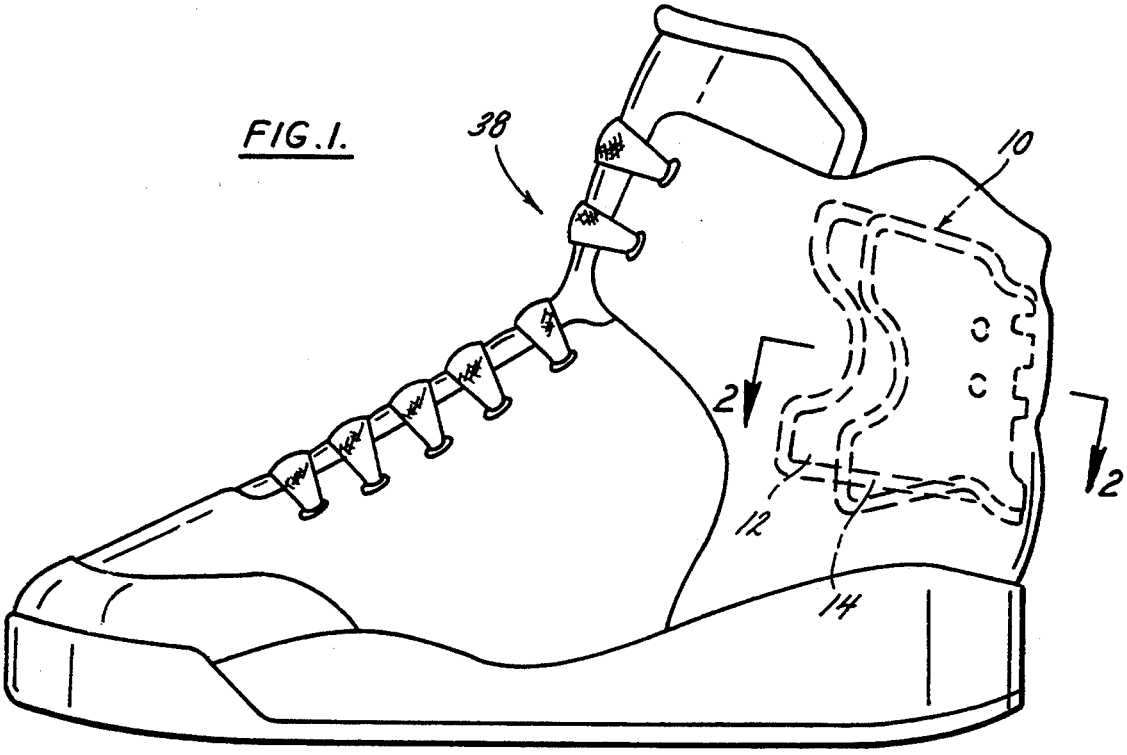
FIG. 1.
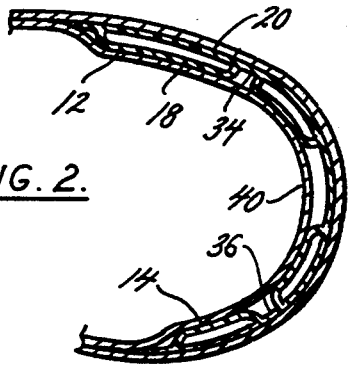
FIG. 2.
FIG. 4.
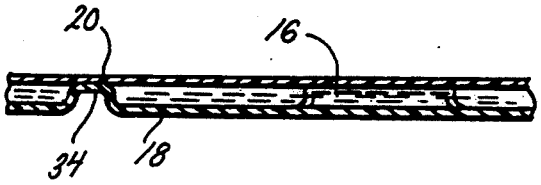
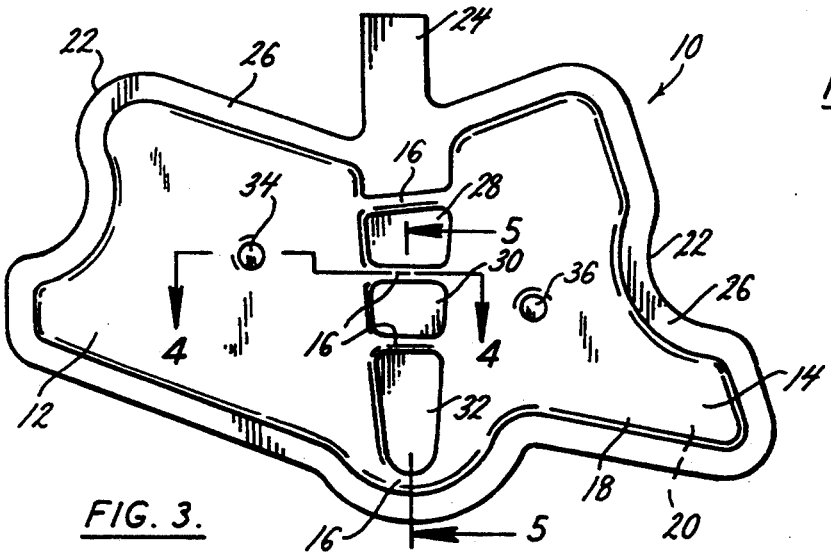
FIG. 3.
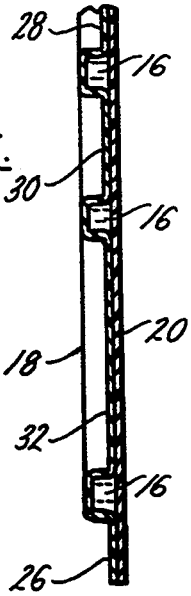
FIG. 5.

REACTIVE ENERGY APPARATUS PROVIDING A CUSTOM FIT AND ANKLE SUPPORT IN A SHOE UPPER

BACKGROUND OF THE INVENTION (1) Field of the Invention

The present invention relates to a fluid filled apparatus which reacts with the stimulus of an outside force, hereinafter referred to as Reactive Energy Apparatus in a shoe upper that provides a custom fit to a shoe wearer's ankle and support for the ankle. In particular, the present invention pertains to anatomically shaped fluid filled bladders or pads that are enclosed in the upper of a shoe and are positioned in the upper to engage and assume a complementary custom fitting configuration by creating uniform pressure to both sides of the shoe wearer's ankle by the displacement of the fluid. The fluid pads are separated by a portion of the shoe upper in the area of the wearer's Achilles tendon to avoid exerting a force against and possibly causing injury to the Achilles tendon.

(2) Description of the Related Art

Various methods and devices have been employed in the prior art seeking to develop a shoe upper that provides ankle support to a wearer of a shoe while also providing a comfortable fit around the ankle. This is especially true in the field of athletic footwear, for example in high top football and basketball shoes and in ski boots.

In many types of shoes, in order to provide support to the ankle the shoe upper must be securely closed or laced tight around the ankle of the shoe wearer. In efforts to make such a shoe upper comfortable to the shoe wearer, padding is provided around the shoe upper in the area of the ankle. However, in many situations the padding of the shoe upper provides a tight supporting fit around the wearer's ankle for only a limited extent of movement of the ankle. Because the padding is fixed to the inside of the shoe upper, in many bending movements of the ankle the shoe upper, along with its padding, create unequal pressure around the ankle, thereby reducing or eliminating its support for the ankle.

To overcome the inability of the padded shoe upper to continuously move with the ankle and provide a continuous supporting and comfortable fit of the shoe upper around the ankle, shoe uppers with fluid filled pads were developed.

The fluid filled pads conform to the shape of the shoe wearer's ankle as the shoe upper is secured around the ankle. During movement of the ankle, the fluid in the pads is displaced, causing fluid to be forced from the pad in areas of the shoe upper where the ankle exerts pressure on the pad, and causing the displaced fluid to flow to areas of the pad where ankle pressure is reduced during movement. The flow of fluid within the compartments where ankle pressure is reduced causes the compartments to expand in these areas and maintain a comfortable, supporting contact with the ankle.

However, many prior art shoe uppers containing fluid filled pads are disadvantaged in that the pads exert pressure on sensitive areas of the wearer's ankle during certain movements of the ankle. Prior art fluid filled pads designed to provide continuous support to opposite sides of the ankle typically extended completely around the ankle to enable fluid from one side to flow freely to the other side of the fluid pad. These prior art pads also exert fluid pressure on the sensitive area of the Achilles tendon. During some movements of the ankle, the fluid pressure exerted on the Achilles tendon could lead to injury of the tendon.

What is needed to provide a comfortable and supporting fit to the ankle of a shoe wearer is a shoe upper incorporating a Reactive Energy Apparatus that is dynamically reactive to provide a continuously changing comfortable and supporting fit of the shoe upper around the ankle of a wearer as the ankle moves. It is important that the Reactive Energy Apparatus does not apply pressure on the Achilles tendon that could lead to injury.

SUMMARY OF THE INVENTION

The present invention satisfies the needs of the prior art by providing a Reactive Energy Apparatus in a shoe upper that enables the upper to provide a supporting, custom fit to the ankle of a wearer, where the fit is dynamically changing as the ankle goes through movements and where the fit avoids exerting pressure on the Achilles tendon of the wearer, thereby avoiding any potential for injuring the Achilles tendon.

The Reactive Energy Apparatus of the present invention is generally comprised of a pair of fluid filled pads or bladders provided in the upper of a shoe at opposite sides of the upper. The positioning of the pads spaces them on opposite sides of the Achilles tendon of a shoe wearer to prevent the pads from exerting any pressure on the tendon. The pads are connected in fluid communication by a plurality of conduits that extend between the pads around the area of the wearer's Achilles tendon. The conduits are dimensioned sufficiently small and are spaced apart over the area of the tendon to avoid their exerting any pressure on the tendon. The apparatus of the invention is described as being contained in the upper of an athletic shoe. However, the description of the apparatus being enclosed in the upper of an athletic shoe is illustrative only, and the apparatus of the invention may be incorporated into the uppers of various different kinds of shoes.

Spaced, fluid filled pads are constructed as component parts of a single apparatus that may be easily inserted into the upper of a shoe. Each of the pads are constructed comprising one or more interior chambers containing fluid. The apparatus is constructed from overlapping sheets of flexible fluid barrier material. The sheets are bonded together along a perimeter boundary that extends completely around the fluid filled pads of the unit. The overlapping sheets are bonded along a medial section of the sheets extending between the fluid filled pads. The sealed medial section separates the fluid filled pads and provides an open area that corresponds to the area of a shoe upper that covers the Achilles tendon.

Fluid conduits are formed between the overlapping sheets. The conduits extend between and provide communication between the fluid filled pads. The conduits extend across the medial section of the apparatus, with areas of the medial section being bonded between adjacent conduits. The bonded areas of the medial section separate the fluid filled pads from one another, and also separate the adjacent fluid filled conduits from each other.

The bonded perimeter boundary of the apparatus is shaped in a configuration to fit in a shoe upper and provide support to the ankle on opposite sides of the Achilles tendon in the areas above, below and behind the malleoli. With the shoe upper secured around the wearer's ankle, the fluid contained in the pads causes the pads to assume an anatomical shape to that of the sides of a wearer's ankle. The conforming shape of the pads to the opposite sides of the ankle provides a custom fit of the shoe upper around the ankle, and also provides support to the ankle.

As the ankle moves during running or other activities, it exerts pressure on the fluid filled pad contained in the side of the upper toward which the ankle moves. The pressure exerted on the one pad causes the fluid to flow from the chamber or chambers of that pad, through the conduits, to a pad chamber or chambers of lesser pressure on the opposite side of the shoe upper, causing that pad to expand and maintain its supporting contact with the flexing ankle as the ankle moves away from the other pad. In this manner, the apparatus of the invention provides a continuous supporting, custom fit to the wearer's ankle while avoiding exerting any significant pressure to the Achilles tendon that could lead to injury.

BRIEF DESCRIPTION OF THE DRAWINGS

Further objects and features of the present invention are revealed in the following Detailed Description of the Preferred Embodiment of the invention and in the drawing figures wherein:

FIG. 1 is an elevation view of an athletic shoe incorporating the reactive energy apparatus of the invention showing the relative position of the apparatus in the upper of the shoe;

FIG. 2 is a partial cross section of the shoe upper showing the position of the apparatus of the invention inside the upper taken along the line 2—2 of FIG. 1;

FIG. 3 is a plan view of the reactive energy apparatus of the present invention removed from the upper of the shoe;

FIG. 4 is a cross section of the apparatus of the invention taken along the line 4—4 of FIG. 3; and FIG. 5 is a cross section of the apparatus of the invention taken along the line 5—5 of FIG. 3.

DESCRIPTION OF THE PREFERRED EMBODIMENT

FIG. 3 shows the reactive energy ankle support apparatus of the present invention 10 removed from the shoe upper. As seen in FIG. 3, the apparatus 10 is comprised of a first, inside fluid containing pad or bladder 12, a second, outside fluid containing pad or bladder 14, and a plurality of fluid conduits 16 communicating the first and second pads.

Each of the pads 12, 14 are constructed comprising one or more interior chambers containing fluid. The pads 12, 14 are formed as component parts of a single unit of the apparatus, the unit being constructed from a pair of overlapping sheets 18, 20 of a flexible, barrier material. The sheets are preferably cut from a plastic that can be bonded.

As seen in FIG. 3, the pair of sheets 18, 20 have a peripheral boundary 22 cut in a specific configuration to extend the pads 12, 14 below, behind and above the malleoli. The configuration of the unit perimeter 22 is also chosen to conform to the upper of the shoe with which the unit will be used, although this a secondary consideration. The primary consideration in determining the configuration of the unit perimeter boundary 22 is to extend the pads 12, 14 around the opposite sides of the ankle sufficiently to provide a custom fit and support to the ankle. In forming the perimeter boundary 22, one or more tabs 24 may be provided around the perimeter boundary of the apparatus 10. The tab or tabs 24 may be employed in positioning and securing the apparatus in the upper of a shoe or other method of positioning and securing the apparatus in the shoe may be employed.

Overlapping sheets 18, 20 are bonded around the peripheral boundary 22 of the apparatus. The bond is a fluid tight seal that forms a completely enclosed interior chamber in each of the fluid pads 12, 14. Although the fluid pads are described as enclosing only one interior chamber each, in variant embodiments of the invention the pads may enclose two or more chambers that are interconnected in fluid communication with each other.

Overlapping areas of the two sheets 28, 30, 32 extending across a center section of the apparatus 10 are also bonded. As seen in FIG. 3, each of the separate areas 28, 30, 32 are separated from each other and are separated from the bonded boundary 26 by conduits 16 extending between the two pads 12, 14. The conduits 16 are formed when areas of the two overlapping sheets on opposite sides of the conduits are bonded. A central point 34, 36 in each fluid pad 12, 14 is also bonded to secure the overlapping sheets together at these points and prevent excessive expansion of the fluid pads as fluid enters the pads.

Each of the pads 12, 14 is filled with a moderately viscous composite fluid. Several different types of composite fluids may be employed as the fluid filling the pads. The composite fluid could include two fluids having different viscosities, or the fluid could include solids, including but not limited to hollow spheres or particles suspended in the fluid. In viewing FIG. 3, it can be seen that as a pressure is exerted on the left, inside pad 12, the fluid contained in the pad will be forced through the conduits 16 to the right, outside pad 14, causing the outside pad to expand out of a plane generally defined by the overlapping sheet 18, 20. Also, as a pressure is exerted on the right, outside pad 14, the pressure will force the fluid contained in the pad to flow through the conduits 16 to the left, inside pad 12, causing the inside pad to expand out of the plane generally defined by the pair of sheets 18, 20. The forces exerted by the apparatus are limited to the areas of the pads. The bonded sections 20, 30, 32 extending through the center of the apparatus 10 prevent any appreciable expansion of the fluid conduits 16 due to an increase in the pressure of the fluid contained in the conduits. In this manner, the fluid is permitted to flow back and forth between the inside and outside pads 12, 14 causing the pads to expand and exert a force on the inside and outside surfaces of the ankle, while still being prevented from exerting any pressure on the Achilles tendon as the fluid passes between pads.

FIG. 1 shows the apparatus of the invention in its relative position in the upper of an athletic shoe 38 for the left foot. Only the outer ankle side or left side of the shoe can be seen in FIG. 1. However, the relative position of both the inside ankle pad 12 and the outside ankle pad 14 on the opposite sides of the shoe are shown in FIG. 1.

In a typical athletic shoe of the type shown in FIG. 1, as the upper of the shoe is secured around the ankle of a wearer, the interior surface 40 of the upper engages against the malleoli. The projecting sides of the ankle bone creates a space between the interior surface 40 of the upper and the surface of the ankle above, behind and below the projections of the malleoli. In viewing FIG. 1, it can be seen that the configuration of the fluid filled pads 12, 14 of the apparatus 10 is chosen to fill the spacing between the interior surface 40 of the shoe upper and the ankle surfaces above, behind and below the malleoli. As the shoe upper 38 incorporating the apparatus 10 is secured around the ankle of the shoe wearer, the fluid contained in the pads 12, 14 causes the pads to assume a configuration complementary to the configuration of the ankle surface above, behind and below the malleoli. In this way the apparatus 10 of the present invention provides a custom fit of the shoe upper 38 to the ankle of the particular wearer of the shoe. The engagement of the fluid filled pad 12, 14 with the malleoli also provides support to the ankle.

With the shoe upper of the invention, containing the apparatus 10, secured around the ankle of the wearer, as the ankle moves during walking, running or other movements, it moves inside the shoe upper 38. The movement of the ankle in the shoe upper 38 causes the ankle to exert continuously changing and varying degrees of pressure against the pair of fluid pads 12, 14. As the ankle presses against one pad, increasing the pressure on the pad, the fluid contained in the pad is forced through the conduits 16 to the other pad. This causes the pad on which the pressure is exerted to decrease in thickness and results in the other pad, to which the fluid flows, to increase in thickness.

In a conventional shoe, the movement of the ankle towards one side of the shoe upper most often causes the opposite side of the shoe upper to separate from the ankle and thereby reduce or eliminate its support of the ankle. In the present invention, as the ankle of the wearer moves toward one side of the upper 38 and exerts a pressure on the fluid pad contained in that side of the upper, the fluid contained in that pad is forced from the pad, through the conduits 16 to the pad on the opposite side of the shoe away from which the ankle is moving. This causes the pad on the opposite side of the shoe to expand and thereby maintain supportive contact with the opposite side of the ankle as it moves away from the shoe upper. Because the bonded areas 28, 30, 32 in the center of the apparatus 10 prevent any appreciable expansion of the conduits 16 as fluid is passed between the pads 12, 14, no pressure is exerted on the Achilles tendon of the wearer that could potentially lead to an injury.

In this manner, the Reactive Energy Apparatus 10 of the present invention not only provides a custom fit that conforms to the particular shape of the wearer's ankle, but provides dynamic, continuous support of the ankle during walking, running and other movements.

While the present invention has been described by reference to a specific embodiment, it should be understood that modifications and variations of the invention may be constructed without departing from the scope of the invention as described in the following claims.

What is claimed is:

1. A reactive energy apparatus in a shoe upper providing a custom fit and support to an ankle of a wearer of the shoe, the apparatus comprising:

a first means for containing a fluid on a first side of said shoe upper,s aid first means containing a fluid and said fluid causing said first means to assume a one side of the wearer's ankle and causing said first means to engage in surface contact over the one side of the wearer's ankle as said shoe upper is secured over the wearer's ankle;

a second means for containing a fluid on a second side of said shoe upper, said second means containing a fluid and said fluid causing said second means to assume a shape complementary to a shape of a second side of the wearer's ankle and causing said second means to engage in surface contact over the second side of the wearer's ankle as said shoe upper is secured over the wearer's ankle; and means for spacing said first fluid containing means from said second fluid containing means on opposite sides of an Achilles tendon of the wearer as said shoe upper is secured over the wearer's ankle; and said first fluid containing means and said second fluid containing means are both formed in side by side, spaced relation between a pair of overlapping sheets of flexible, fluid tight material, said first fluid containing means has a first interior chamber enveloped between said pair of sheets and said second fluid containing means has a second interior chamber enveloped between said sheets, said pair of overlapping sheets are sealed together along a perimeter boundary extending around both said first and second interior chambers, said pair of overlapping sheets are sealed together along a medial spacer spacing said first and second interior chambers from each other, said fluid is contained in said first and second interior chambers and said medial spacer prevents said fluid from readily passing between said first and second interior chambers.

2. The apparatus of claim 1, wherein:

at least one fluid conducting conduit is formed between said pair of overlapping sheets extending across said medial spacer and providing fluid communication between said first and second interior chambers.

3. The apparatus of claim 1, wherein:

a plurality of fluid conducting conduits are formed between said pair of overlapping sheets extending across said medial spacer and providing fluid communication between said first and second interior chambers, said pair of overlapping sheets are sealed together at separate areas along said medial spacer, said separate areas separate said fluid conduits and said fluid conduits separate said sealed areas.

4. The apparatus of claim 1, wherein:

said first fluid containing means is a first pad having a plurality of interior chambers, each of said plurality of interior chamber contains a fluid and each of said plurality of interior chambers is interconnected in fluid communication; and said second fluid containing means is a second pad having a second plurality of interior chambers, each of said second plurality of interior chambers contains a fluid and each of said second plurality of interior chambers is interconnected in fluid communication.

5. A reactive energy apparatus in a shoe upper providing a custom fit and support to an ankle of a wearer of the shoe, the apparatus comprising:

a first means for containing a fluid on a first side of said shoe upper, said first means containing a fluid and said fluid causing said first means to assume a shade of one side of the wearer's ankle and causing said first means to engage in surface contact over the one side of the wearer's ankle as said shoe upper is secured over the wearer's ankle;

a second means for containing a fluid on a second side of said shoe upper, said second means containing a fluid and said fluid causing said second means to assume a shape complementary to a shape of a second side of the wearer's ankle and causing said second means to engage in surface contact over the second side of the wearer's ankle as said shoe upper is secured over the wearer's ankle;

means for spacing said first fluid containing means from said second fluid containing means on opposite sides of an Achilles tendon of the wearer as said shoe is secured over the wearer's ankle;

means for conducting fluid extend between said first and second fluid containing means, said means for conducting fluid providing fluid communication between said first and second fluid containing means;

said means for conducting fluid includes a plurality of fluid conduits extending between said first and second fluid containing means, said plurality of conduits extend substantially parallel to each other; and said means for spacing said first fluid containing means from said second fluid containing means also spaces said plurality of conduits from each other, said spacing means being interposed between adjacent conduits of said plurality of conduits.

* * * * *